US005392721A

United States Patent [19]

Judd

[11] Patent Number: 5,392,721

[45] Date of Patent: Feb. 28, 1995

[54] METHOD FOR RECYCLING PAPERMAKING SLUDGE

[75] Inventor: Wendell Judd, Fairfield, Ohio

[73] Assignee: Technology Development Corp., Fairfield, Ohio

[21] Appl. No.: 238,872

[22] Filed: May 6, 1994

[51] Int. Cl.[6] ..... F23G 5/00

[52] U.S. Cl. ..... 110/346; 110/226; 110/238; 110/246

[58] Field of Search ..... 110/238, 226, 246, 346

[56] References Cited

U.S. PATENT DOCUMENTS

| | | | |
|---|---|---|---|
| 1,166,509 | 1/1916 | Ayerst et al. . | |
| 2,026,366 | 12/1935 | Stehli . | |
| 2,139,419 | 12/1938 | Moreton | 110/14 |
| 3,188,751 | 6/1965 | Sutton | 34/12 |
| 3,218,995 | 11/1965 | Yoshihara et al. | 110/14 |
| 3,320,076 | 5/1967 | Sutton | 106/72 |
| 3,320,908 | 5/1967 | Ostrin | 110/14 |
| 3,357,382 | 12/1967 | Matteini | 110/14 |
| 3,685,437 | 8/1972 | Panning | 100/45 |
| 3,826,208 | 7/1974 | Williams | 110/15 |
| 3,848,548 | 11/1974 | Bolejack et al. | 110/7 R |
| 3,849,246 | 11/1974 | Raymond et al. | 162/4 |
| 3,957,528 | 5/1976 | Ott et al. | 106/309 |
| 4,052,151 | 10/1977 | Reichert et al. | 432/115 |
| 4,066,024 | 1/1978 | O'Connor | 110/8 F |
| 4,120,738 | 10/1978 | Tate | 106/288 Q |

(List continued on next page.)

FOREIGN PATENT DOCUMENTS

| | | |
|---|---|---|
| 112544 | of 1977 | Japan . |
| 79700 | 2/1979 | Japan . |
| 100222 | 8/1981 | Japan . |
| 1407703 | of 1975 | United Kingdom . |

OTHER PUBLICATIONS

1971, Jul., S. D. Warren, Co., "Sludge Material Recovery System for Manufacturers of Pigmented Papers," US Environmental Protection Agency Report W72-11605.

1972, Jul. 10, S. D. Warren, Co., "A Sludge Recovery System for Use in Pigmented Paper Production", Paper Trade Journal, p. 44 ff.

1973, Apr. E. L. Spruill, "Color Removal and Sludge Recovery from Total Mill Effluent", Tappi, vol. 56, No. 4, Apr. 1973.

1976, L. Söderhjelm, "Possible Uses for Fibrous Sludges from the Pulp and Paper Industry", Paper ach Trå, No. 9, 1976, pp. 621 ff.

1980: K. Khitano, "Sludge Utilization and Researches Now Underway in Shikuoka", Japan Pulp and Paper, vol. 18 (2), 1980.

1988, May 24–26, T. J. Wittmann, F. W. Koester, "The Co-Processing of Wastes in the Cement Manufacturing Plant", IEEE, Record of the 29th Cement Industry Technical Conference.

*Primary Examiner*—Edward G. Favors

*Attorney, Agent, or Firm*—George Wolken, Jr.

[57] ABSTRACT

The present invention provides methods for the reduction and recycling of papermaking sludge. Papermaking sludge is incinerated in a rotary heater, typically a rotary cement kiln, asphalt dryer, or specially designed rotary kiln or incinerator. Aggregate may be combined with the sludge to provide better dispersion of the sludge within the heater, and to facilitate heat transfer. Once in operation, the heat of sludge combustion is added to the process heat, resulting in markedly reduced energy requirements. Papermaking sludge is typically fed continuously into said rotary heater while temperatures in the combustion zone are maintained in the range of approximately 800° to 3500° F. During incineration, mixing catalysts (typically casein or soy protein) and wood fibers are burned, while moisture is evaporated. The resulting product consists essentially of carbonate particles which are collected for subsequent use.

10 Claims, 2 Drawing Sheets

U.S. PATENT DOCUMENTS

| | | | |
|---|---|---|---|
| 4,235,174 | 11/1980 | Spurrell | 110/346 |
| 4,245,571 | 1/1981 | Przewalski | 110/246 |
| 4,301,750 | 11/1981 | Rito et al. | 110/346 |
| 4,338,869 | 7/1982 | Hoskinson | 110/346 |
| 4,356,060 | 10/1982 | Neckermann et al. | 162/181.6 |
| 4,361,100 | 11/1982 | Hinger | 110/238 |
| 4,541,346 | 9/1985 | Culliford | 110/246 |
| 4,546,711 | 10/1985 | Kerwin | 110/246 |
| 4,575,336 | 3/1986 | Mudd et al. | 432/72 |
| 4,599,954 | 7/1986 | Williams | 110/346 |
| 4,626,202 | 12/1986 | Chisaki et al. | 432/107 |
| 4,666,612 | 5/1987 | Hoffman et al. | 210/768 |
| 4,701,222 | 10/1987 | Kobayashi et al. | 106/288 B |
| 4,751,887 | 6/1988 | Terry et al. | 110/246 |
| 4,756,761 | 7/1988 | Philip et al. | 106/117 |
| 4,770,831 | 9/1988 | Walker | 264/82 |
| 4,772,330 | 9/1988 | Kobayashi et al. | 106/400 |
| 4,794,871 | 1/1989 | Schmidt et al. | 110/341 |
| 4,840,129 | 6/1989 | Jelinek | 110/229 |
| 4,840,132 | 6/1989 | Jose | 110/246 |
| 4,846,083 | 7/1989 | Serbent | 110/344 |
| 4,900,360 | 2/1990 | Whitescarver et al. | 106/97 |
| 4,938,155 | 7/1990 | Williams | 110/345 |
| 4,952,147 | 8/1990 | Boyden et al. | 432/103 |
| 4,957,048 | 9/1990 | Beer et al. | 110/238 X |
| 4,970,971 | 11/1990 | Williams | 110/346 |
| 4,993,331 | 2/1991 | White et al. | 110/246 |
| 5,078,593 | 1/1992 | Schreiber, Jr. et al. | 110/238 X |

METHOD FOR RECYCLING PAPERMAKING SLUDGE

BACKGROUND OF INVENTION

This invention relates to a method for recycling waste products. More particularly, this invention relates to a method for the recycling of papermaking sludge produced as waste material in the manufacture of paper, cardboard, tissue and related products. This invention relates to a recycling method for such papermaking sludge, producing thereby waste much reduced in bulk for more effective disposal in landfills; waste much reduced in potential toxicity; waste material useful as component materials in the manufacture of cement block, brick and other products; waste material useful as an additive and extender in gravel, backfill and other operations.

This invention is a modification and improvement of the method for reducing and recycling papermaking sludge described and claimed in U.S. Pat. No. 5,018,459.

Paper manufacturing processes typically begin with a slurry of pulp and water produced as output from a separate pulping process. This pulping process itself produces many kinds of waste materials, not the subject of the present invention. The pulp slurry is typically delivered to the papermaking facility, additional chemicals may be added, and the resulting pulp and water slurry made into paper by means of a variety of processes, typically involving rapid withdrawal of the water through a screen, depositing thereby the paper onto the screen. The waste water is reprocessed to recover as much usable material and reusable water as economically feasible. Typically, the water is sent to a "settling tank" in which heavier components settle to the bottom of the tank and are drawn off as "sludge". This sludge is typically processed further to remove additional water (typically by mechanical pressing), leading to a quantity of sludge for final disposal. This sludge is known in the industry by a variety of names, including: "primary waste treatment sludge", "paper mill sludge", "process residual", "waste treatment sludge", "waste treatment plant ('WTP') sludge", to name a few. For simplicity, we will use the term "papermaking sludge" to denote this product, or merely as "sludge". The reprocessing and recycling of this papermaking sludge is the subject of the present invention.

The manufacture of paper, cardboard and related products typically results in large quantities such papermaking sludge. As an approximate rule-of-thumb, 20% of the tonnage of paper products produced by a given paper mill will be produced as sludge waste by-product. Thus, larger paper mills can easily produce in excess of 500 tons per day of sludge requiring disposal.

This papermaking sludge contains large amounts of water, wood fibers, calcium carbonate, other minerals and clays, various mixing catalysts (typically soy protein or casein), and chlorine-based purifying agents used in the paper making process. There is no precise composition for this sludge because there are substantial variations in the wood and other feedstocks used; in the processing materials which must be used to make different types of paper products; and even considerable variation in the processes used by different paper makers in making similar products.

The disposal of this papermaking sludge is a continuing problem for the paper manufacturers and for the environment in general. Current practice is to subject the sludge to a mechanical pressing operation to remove excess moisture. The resulting residue still holds large quantities of water, as well as the other materials listed above. Under current procedures, this residue is then typically deposited into a landfill for indefinite storage.

There are several problems associated with this treatment of papermaking sludge. First of all, it is getting increasingly difficult to locate suitable landfills as existing landfills become full and residents often oppose expansion or creation of new landfills near residences. In addition, the materials which leach from sludge deposited into landfills is hazardous itself. This increases the cost of engineering a suitable disposal site (due to the increased costs of handling such leachates), and increases community and environmental concerns.

The present invention proposes an alternative treatment for this papermaking sludge, as a modification and improvement of that described in U.S. Pat. No. 5,018,459. The present invention markedly reduces the bulk of the sludge to be disposed (by typically 75%), thereby markedly extending the life of disposal landfills. Also, the present invention produces a material for disposal that is much less susceptible to leaching, thereby reducing the potential environmental hazards for landfills.

In addition, the present invention offers the possibility of dispensing with landfills entirely. The present invention demonstrates how papermaking sludge can be processed into a commercial product similar to re-calcified calcium carbonate. (Due to the variation in composition of the sludge noted above, the processed sludge from the present invention has varying compositions.) This processed sludge has many of the useful properties of calcium carbonate and finds use in asphalt, asphalt sealers and coatings, concrete block and pipe, other brick and structural pipe, for gravel-based construction operations such as parking lots or highways, as an additive to backfill material for sewer water and gas pipelines, in ceramics and many other applications.

U.S. Pat. No. 5,018,459 describes a one-step reduction and recycling process by use of a rotary kiln. The rotary kiln has the effect of placing the sludge into suspension. While in suspension, the combustible components of the sludge dry then ignite, thereby adding their heat energy to the process. Thus, the external energy (typically natural gas) required by the process of U.S. Pat. No. 5,018,459 is markedly reduced by the use of rotary kilns.

The present invention represents an improvement of U.S. Pat. No. 5,018,459 in that aggregate is added to the process along with the sludge. The use of aggregate in combination with sludge in a rotary kiln seems to have at least four beneficial effects. 1) The rotation of the aggregate along with the sludge helps keep the sludge in suspension, adding to the efficiency of mixing and combustion. 2) Heated aggregate retained in the rotary kiln serves to increase heat transfer to the sludge, tending to pre-heat and partially dry sludge before the sludge reaches the hot zone of the kiln. 3) Certain aggregates (such as limestone or limestone-containing aggregate) serve to adjust the pH of the process towards alkaline. 4) Some evidence suggests that proper pH control of the process tends to hinder or suppress the formation of dioxins and furans. Aggregate is commonly used in rotary kilns as a means for promoting suspension of materials otherwise prone to agglomeration (sometimes referred to as a mixing "catalyst" although the effect is primarily mechanical-to promote mixing-rather than to catalyze chemical changes.) However, we are aware of no use of aggregate, prior to the present invention, in rotary kiln recycling of papermaking sludge, having the beneficial effects noted above.

Several other approaches have been tried for the disposal of papermaking sludge. These generally fall into two catagories: simple incineration; complex, multistep processing, typically attempting to extract higher value materials from the sludge.

There have been several approaches to the disposal of papermaking sludge involving complex, multistep processes. Such processes typically involve attempts to extract additional usable materials (like titanium) from specialized types of papermaking sludge. Of necessity, such processing involves numerous steps, some of them quite complex and expensive in their own right. Typical examples include the work of Goto (Aug. 12, 1981, S. Goto, "Use of Paper Sludge for Cement Manufacture", Unexamined Japanese patent application no. 2905-1908, disclosure no. 100222-1981). This work uses a hot dryer (rather than an incinerator) for preliminary processing of papermaking sludge to reduce it to a cake. This cake is then pulverized mechanically with a rotating fork-like machine to make small particles such that 70% of the total have diameters 0.5 mm or less. The resulting small particles are burned, perhaps in a rotary kiln or fluidized bed incinerator. Missing the essential simplicity (and, therefore, the economy) of the present invention, the Goto work has not had a significant effect on eliminating sludge from landfills.

Another typical approach is illustrated by the study published by the S. D. Warren Co. (1971, July, S. D. Warren, Co., "Sludge Material Recovery System for Manufacturers of Pigmented Papers," US Environmental Protection Agency Report W72-11605). A study is reported investigating processes by means of which waste sludge from papermaking might be used to produce a product which can be reused as a component of papermaking once again. This study has a very complex process in which: 1) Gritty materials first are removed from sludge (the present process has no such restriction); 2) The waste sludge to be processed must have high inorganic pigment content and low fibrous content (the present process prefers high fiber content to add to the heat of combustion but is quite feasible with lower fiber contents). 3) A multistep process then follows, with sludge dilution, consistency regulation, centricleaning, vacuum filtering, shredding, drying, followed by processing in rotary kiln. 4) The resulting product is used back into paper. Typical of such complex, multistep processes, this study concludes that high capital cost makes this process "not economically feasible" at this time (Conclusion #8, page 1). The essence of commercial feasibility is often simplicity. The present invention has one of its foundations in the essential simplicity of the process, previously overlooked, or obscured by attempts to extract other products from sludge.

The other broad class of attempts to dispose of papermaking sludge involves simple combustion of the sludge in a bark-burning boiler, hog fuel burner, or other incinerator. While disposing of sludge, these techniques typically require large amounts of additional process fuel, thereby drastically reducing the economics of the process and erecting serious barriers to practical commercial use.

In contrast, the present process (and the U.S. Pat. No. 5,018,459 process), using a rotary kiln, require only moderate amounts of gas and render the process economically feasible. Indeed, the present process typically is run with a large natural gas flame until the sludge is in suspension and adding its heat energy to the process. Once this occurs, the natural gas flame is reduced and the process becomes almost completely self-sustaining. On a simple heat balance, for each pound of sludge, combustion of the wood fibers typically generates approximately twice the heat necessary to drive off the water from a similar pound of sludge. Therefore, under theoretically ideal conditions, the papermaking sludge would be a net fuel source while producing commercially useful ash as a combustion product. In practice, however, additional heat has been required to make the process occur continuously in a practical way. Nevertheless, it is common to be able to reduce the initial gas flame to only 10% (or less) of its initial gas consumption once sludge heat joins the process. Therefore, in continuous operation the start-up energy consumption becomes negligible and the rotary kiln process of the present invention is markedly energy-efficient.

SUMMARY AND OBJECTS OF INVENTION

The present invention provides methods for the reduction and recycling of papermaking sludge. Papermaking sludge is incinerated in a rotary heater, typically a rotary cement kiln, asphalt dryer, or specially designed rotary kiln or incinerator. Aggregate may be combined with the sludge to provide better dispersion of the sludge within the heater, and to facilitate heat transfer. Once in operation, the heat of sludge combustion is added to the process heat, resulting in markedly reduced energy requirements. Papermaking sludge is typically fed continuously into said rotary heater while temperatures in the combustion zone are maintained in the range of approximately 800° to 3500° F. During incineration, mixing catalysts (typically casein or soy protein) and wood fibers are burned, while moisture is evaporated. The resulting incinerated product consists essentially of carbonate particles which are collected for subsequent use.

A primary object of this invention is to reduce the bulk of papermaking sludge for ease of disposal.

Another object of this invention is to remove materials from the papermaking sludge prior to disposal which may leach into surrounding land and water.

Still another object of this invention is to produce a material from papermaking sludge having many of the useful properties of calcium carbonate.

Yet another object of the present invention is to provide a method for the disposal of papermaking sludge in which aggregate is used to hinder agglomeration of sludge during processing.

Another object of the present invention is to provide a method for the disposal of papermaking sludge in which aggregate is used to facilitate heat transfer to the sludge.

Another object of the present invention is to provide a method for the disposal of papermaking sludge in which aggregate, typically limestone containing aggregate, is used to control the pH during processing.

Still another object of the present invention is to provide a method for the disposal of papermaking sludge in which the presence of aggregate hinders the formation of dioxin or furan by-products during processing.

Another object of the present invention is to reduce energy consumption in the reduction of papermaking sludge by using sludge combustion heat as process heat.

Yet another object of this invention is to convert papermaking sludge from a waste product into a material useful for many applications in the manufacture asphalt, asphalt sealers and coatings, ceramics, concrete block and pipe, other brick and structural pipe and other products.

Yet another object of this invention is to convert papermaking sludge from a waste product into a material useful for many applications in gravel-based construction operations such as parking lots or highways, as an additive to backfill material for sewer, water and gas pipelines, and other applications.

DESCRIPTION OF PREFERRED EMBODIMENTS

The present invention comprises methods for the reduction and recycling of papermaking sludge. The specific equipment used to implement such methods is not the subject of the present invention. However, we will use a reasonably generic description of equipment in order to make our discussion of the methods more definite. The detailed assembly of equipment for the practice of the present invention, as well as the advantages and disadvantages of such equipment, is still the subject of engineering research and development.

Figure 1:
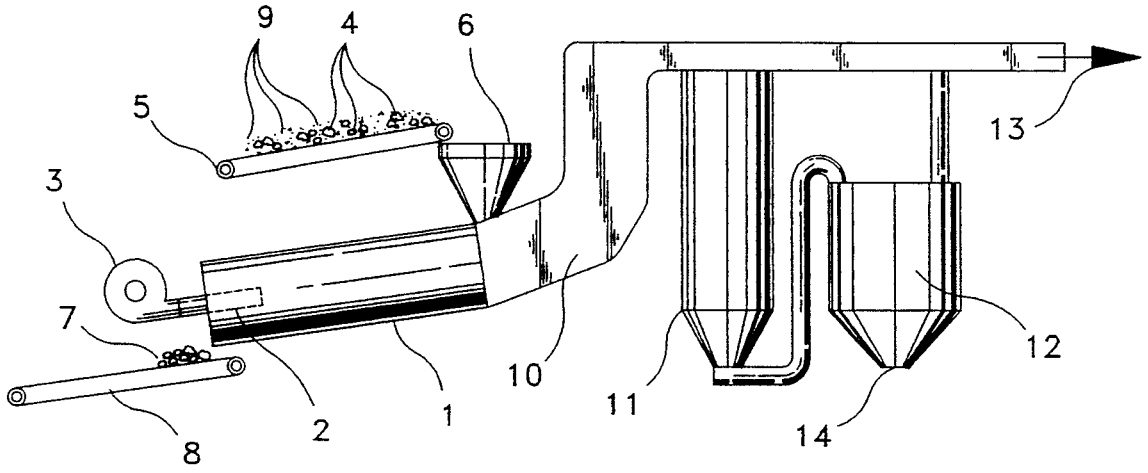
FIG. 1: A schematic representation of a typical apparatus in which incineration of papermaking sludge is performed, having aggregate continuously added with sludge, and extracted from the apparatus for recirculation.

A typical piece of equipment for the implementation of the present invention, as shown schematically in FIG. 1, would consist of a rotating heater or kiln (1), a burner or other source of heat (2) for introducing heat into one end thereof, and a means (3) for controlling the fuel to burner (2) and, therefore, the amount of heat added to the process. Typically, burner (2) would be a gas or oil-fired burner controlled by a blower (3) or other standard devices for the introduction and control of such burners. The rotating heater (1) would typically be a type used as asphalt dryer, rotary cement kiln or other type rotating incinerator. Numerous such designs are well known, and specialized types of rotating heaters may be designed for specific processes, such as those processes for sludge recycling described herein.

Aggregate is used in the process of the present invention primarily as a means to promote mixing and to keep the papermaking sludge more readily in suspension for efficient combustion. Other purposes of the aggregate include providing more efficient heat transfer to the sludge, thereby promoting drying of the sludge for easier combustion. To accomplish these primary goals, there are numerous specific ways the process could be implemented.

Naturally occurring stone aggregate, typically crushed to the appropriate size, is the most common additive included in the rotary kiln in the practice of the present invention. This is primarily due to its relatively low cost and ready availability. However, it is also possible to practice the present invention using metallic, ceramic, or other heat-resistant particles in place of stone aggregate. For economy of language we use the term "aggregate" herein to include such manufactured or processed materials as well as natural, typically crushed, stone.

There are two general approaches to the recycling of papermaking sludge with the addition of aggregate: a) Continuous introduction of aggregate and sludge to the kiln, along with recirculation of aggregate external to the system and reintroduction along with sludge; and, b) One-time charging of the kiln with aggregate followed by continuous use of aggregate internal to the system.

In the first of such general methods, aggregate is continuously introduced into the kiln along with the sludge, as shown in FIG. 1. In this procedure, aggregate is continuously removed from the kiln, and reused as input material along with the sludge. We show in the FIG. 1 a conveyer (5) introducing aggregate (4) and sludge (9) continuously into the upper end of kiln (1) through a suitable feeding hopper (6). Typically, aggregate would consist of gravel particles in a size range of approximately 0.25 to 2.0 inches in lateral extent (although 1.5 to 1.75 inches is presently preferred). Finer pieces of aggregate and aggregate dust would tend to be removed from the process along with the dust and ash of the incinerated papermaking sludge. For typical uses of the final product, modest amounts of fine aggregate particles and aggregate dust do not present serious problems and, with the use of limestone aggregate, may enhance properties for some uses.

FIG. 1 shows aggregate (4) and sludge (9) introduced into the kiln in intermittent clumps on conveyer (5). More commonly, sludge and aggregate would be mixed in a bin and introduced onto the conveyer (5) in a more or less uniform mixture. Either method may be employed depending upon the particular characteristics of the apparatus in use.

FIG. 1 shows aggregate (typically hot aggregate) being removed from kiln (1) by means of conveyer (8). Due to the larger mass of aggregate particles, aggregate will not typically become entrained in the flowing air and gas stream from heater (2) and blower (3) and drop onto conveyer (8). The fine particles of incinerated sludge will typically be blown by blower (3) out of the kiln into ducting system (10) for collection, typically by means of a cyclone dust collector (11), connected to an ash bin (12), and finally by means of connection (13) to a bag house (not shown) for final collection. Incinerated papermaking sludge is typically collected from the ash bin (12) through an opening in the bottom thereof (14) for hauling away for other uses. Collection from other points within the system, such as the bag house or the dust collector may also be prudent under various operating conditions.

Collected aggregate (7) may be remixed with the sludge for reintroduction into the kiln almost immediately, or may be collected, cooled and then recirculated. Rapid reuse of the aggregate has the advantage of using some of the process heat in the form of hot aggregate to begin the process of drying the sludge as soon as mixing occurs. Therefore, partially pre-dried sludge may be introduced into the kiln for final incineration if prompt mixing of hot aggregate and wet papermaking sludge is carried out.

On the other hand, considerable heat is generated by combustion of the materials within the sludge, primarily wood fiber. It has been a problem in some preliminary tests that too much process heat is generated, leading to potential hazards with bag house materials, conveyer belts and other components of the system not expected to operate with such heat. Under such circumstances, the removal of hot aggregate and external cooling could be one simple way to remove at least some unwanted excess heat from the system.

Aggregate will typically be limestone-based or quartz-based or a combination of the two depending on the geological conditions of the aggregate source (although other materials may be used, as discussed above). Limestone-based aggregate is known to be alkaline, and therefore, can be helpful in the control of the pH of the sludge during processing. Even when the most convenient local source of aggregate is quartz-based, it is sometimes helpful to add small amounts of limestone-based aggregate to the mix for pH control. In addition, there is some evidence that correct adjustment of pH during processing can have a beneficial effect in retarding or preventing the formation of dioxin- or furan-type combustion by-products.

FIG. 1 shows heater (2) on the downhill side of kiln (1) while sludge is introduced into the uphill side. This is not at all necessary as both sludge and heater may be on the downhill side (as drawn in the U.S. Pat. No. 5,018,459 patent), both may be on the uphill side, or on opposite sides of the kiln with heater uphill and sludge feed downhill (the opposite from FIG. 1). The only restriction is that the sludge needs to spend adequate time in the combustion zone for reasonably complete incineration. The correct "residence time" in the combustion zone varies depending on the temperature and the quantity of sludge to be processed per hour. Typically, means for transporting or retarding the sludge as it moves through the kiln are constructed on the interior of kiln (1) as "flights". The number, type and location of flights will typically be adjusted by the system designer to provide adequate residence time in the combustion zone taking into account numerous factors; including (a) the temperature of the combustion zone, (b) the quantity of sludge to be processed per hour and its typical moisture content, (c) the configuration for feeding sludge into the kiln (uphill or downhill), (d) the inclination angle of the kiln, (e) any effects of the aggregate on speeding or retarding sludge as it travels through the kiln, and typically many other factors. These design derails are not a part of the present invention and, it is expected, many different configurations will be tested and used in the practice of the present invention.

Figure 2:
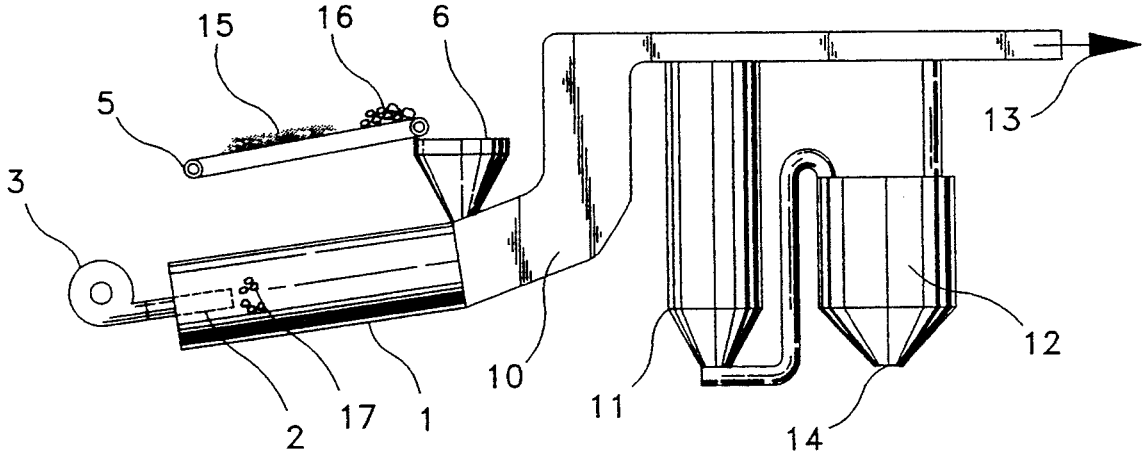
FIG. 2: A schematic representation of a typical apparatus in which incineration of papermaking sludge is performed, having aggregate added at the start of the process and retained within the apparatus for indefinite use.

The second general method of recycling papermaking sludge in the presence of aggregate is to supply or "charge" the kiln initially with aggregate which is then used indefinitely in the process. FIG. 2 shows in schematic form such a typical method of operation. In this approach, an initial quantity of aggregate (16) is fed into the kiln and typically allowed to equilibrate. We show as (17) a quantity of aggregate as retained in the kiln. Typically, there will be internal means for cycling the aggregate in and out of the hot zone of burner (2), but the net effect is typically a steady-state situation in which the appropriate charge of aggregate does not leave the system as sludge is continuously introduced. (In actual practice, lengthy exposure to the heat of this process will cause the aggregate to decompose. Modest amounts of aggregate will be required to "recharge" the kiln from time to time. But the bulk of aggregate remains in the kiln at any given time.) We represent this later introduction of sludge as (15) in FIG. 2, although in practice it will not typically be the case that sludge and aggregate will immediately follow each other into the kiln as may be implied by FIG. 2. Typically, the charge of aggregate will be allowed to come to a steady-state within the kiln and, at that time, introduction of sludge into the kiln begins. However, the particular timing for aggregate and sludge introduction into the kiln, as well as the specific means for the aggregate to obtain steady-state within the system, will vary considerably from apparatus top apparatus. These variations are not an integral part of the methods claimed as the present invention.

As noted above, papermaking sludge contains considerable heat energy, primarily in the form of wood fibers, which can be added to the process heat. By so doing, the consumption of external energy by burner (2) can markedly be reduced. In practice, sludge, or sludge and aggregate in combination, are initially added to the kiln (1) with burner (2) near full operation. Burner (2) is thus used to begin the combustion of sludge. Once sludge combustion is well underway, the supply of fuel to burner (2) can be markedly reduced, typically by 50% to 90%. Thus, in continuous operation the external energy required for the disposal of papermaking sludge can be rather modest.

What I claim is:

1. A method for recycling papermaking sludge comprising the steps of;
   a) mixing papermaking sludge and aggregate,
   b) continuously introducing said mixed sludge and aggregate into a rotating heater,
   c) rotating and heating said heater containing said mixed sludge and aggregate until essentially all water contained in said sludge is removed by evaporation and further, until combustible materials contained in said sludge are incinerated, resulting in a substantially dry product,
   d) separating said incineration product from said aggregate and removing both from said heater.

2. A method as in claim 1 further comprising, immediately following step (d), the step of;
   e) mixing said aggregate promptly upon removal from said heater with sludge for introduction into said heater such that residual heat contained in said aggregate assists in drying said sludge.

3. A method as in claim 1 further comprising, immediately following step (b), the steps of;
   b-1) rotating said heater and simultaneously heating said mixed sludge and aggregate by means of a source of heat to sufficient temperature to initiate combustion of said sludge,
   b-2) reducing the source of heat to a value sufficient to sustain, in combination with said combusting sludge, continuing combustion of sludge as additional sludge enters said rotating heater.

4. A method as in claim 1 wherein said aggregate has a lateral extent of approximately from 0.25 to 2.0 inches.

5. A method as in claim 1 wherein said aggregate contains limestone-based aggregate.

6. A method for recycling papermaking sludge comprising the steps of;
   a) introducing aggregate into a rotating heater for sufficient time for said aggregate to reach operating temperature,
   b) continuously introducing papermaking sludge into said rotating heater with said heated aggregate therein, c) rotating and heating said heater containing said mixed sludge and aggregate until essentially all water contained in said sludge is removed by evaporation and further, until combustible materials contained in said sludge are incinerated, resulting in a substantially dry product, d) separating said product from said aggregate and removing said product from said heater.

7. A method as in claim 6 wherein said aggregate has a lateral extent of approximately from 0.25 to 2.0 inches.

8. A method as in claim 6 wherein said aggregate contains limestone-based aggregate.

9. A method as in claim 6 further comprising, immediately following step (b), the steps of;

b-1) rotating said heater and simultaneously heating said mixed sludge and aggregate by means of a source of heat to sufficient temperature to initiate combustion of said sludge, b-2) reducing the source of heat to a value sufficient to sustain, in combination with said combusting sludge, continuing combustion of sludge as additional sludge enters said rotating heater.

10. A method for recycling papermaking sludge comprising the steps of;

a) introducing papermaking sludge into a rotating heater, b) rotating said heater and simultaneously heating said sludge by means of an external source of heat to sufficient temperature to initiate combustion of said sludge, c) reducing the external source of heat to a value sufficient to sustain, in combination with said combusting sludge, continuing combustion of sludge as additional sludge enters said rotating heater, d) rotating and heating said heater containing said sludge until essentially all water contained in said sludge is removed by evaporation and further, until combustible materials contained in said sludge are incinerated, resulting in a substantially dry product, e) removing said product from said heater.

* * * * *